United States Patent [19]

Hyytinen

[11] Patent Number: 4,532,730

[45] Date of Patent: Aug. 6, 1985

[54] BUTT PLATE CONSTRUCTION OF A FIREARM AND IN PARTICULAR THAT OF A SHOTGUN

[75] Inventor: Timo Hyytinen, Jyväskylä , Finland

[73] Assignee: Valmet Oy, Finland

[21] Appl. No.: 552,076

[22] Filed: Nov. 15, 1983

[30] Foreign Application Priority Data

Nov. 16, 1982 [FI] Finland ..... 823924

[51] Int. Cl.[3] ..... F41C 23/00

[52] U.S. Cl. ..... 42/73; 42/72

[58] Field of Search ..... 42/71 R, 72, 73, 74

[56] References Cited

U.S. PATENT DOCUMENTS

| | | | |
|---|---|---|---|
| 480,587 | 8/1892 | Jones et al. | 42/74 |
| 866,994 | 9/1907 | Wohlwend | 42/74 |
| 1,334,467 | 3/1920 | Moller | 42/74 |
| 1,582,395 | 4/1926 | Haemmerli | 42/73 |
| 3,274,725 | 9/1966 | Pachmayr | 42/74 |
| 3,609,903 | 10/1971 | Pachmayr et al. | 42/74 |
| 3,852,904 | 12/1974 | Drevet | 42/71 R |
| 4,120,108 | 10/1978 | Vickers et al. | 42/74 |

FOREIGN PATENT DOCUMENTS

| | | | |
|---|---|---|---|
| 2231543 | 1/1974 | Fed. Rep. of Germany | 42/74 |
| 1092840 | 4/1955 | France | 42/73 |
| 1536355 | 7/1968 | France | 42/73 |

*Primary Examiner*—Charles T. Jordan
*Assistant Examiner*—Ted L. Parr
*Attorney, Agent, or Firm*—Steinberg & Raskin

[57] ABSTRACT

A butt assembly adapted to be coupled to the end face of the stock of a weapon adapted to be fired from the shoulder, such as a shotgun or the like, comprises a body member including a plate-like portion and mounting studs extending forwardly from the plate-like portion, the mounting studs having bores formed therethrough and extending into bores formed in the rearward end face of the weapon stock to mount the body member thereon, and a butt plate mounted on the plate-like portion of the body member by threaded fastener members which extend through bores formed in the butt plate into the bores of the mounting studs. The butt assembly may also comprise one or more extension members interposed between the body member and butt plate and mounted in position by the same threaded fasteners.

12 Claims, 7 Drawing Figures

BUTT PLATE CONSTRUCTION OF A FIREARM AND IN PARTICULAR THAT OF A SHOTGUN

BACKGROUND OF THE INVENTION

The present invention relates to butt plates for a weapon adapted to be fired from the shoulder, such as a shotgun, in which a butt plate, formed of rubber, plastic or other suitable material, is mounted by means of threaded fasteners, such as screws, to the weapon stock which is formed of wood or other similar material and which in form and dimension is substantially identical to the form and dimension of the rearward face of the weapon stock.

The stocks of weapons which are adapted to be fired from the shoulder, such as shotguns, are generally manufactured of wood by turning and grinding the wood to relatively close dimensions. It has been conventional to fasten or mount a butt plate formed of plastic, rubber or other suitable material to the rearward face of the stock by means of threaded fasteners, such as screws. Conventional butt plates are mated to the external dimensions of the wooden stock during the finishing stages of manufacture by steplessly grinding the plastic or rubber butt plate to the same external dimensions and form as the rearward face of the wood stock.

However, the construction of conventional butt plates and the conventional manufacturing methods described above have several disadvantages. Generally, the replacement of a particular butt plate with another, such as where the existing butt plate has been broken or where it is desired to use a butt plate of a different type, has in the past been a relatively difficult procedure. This disadvantage is mainly the result of the fact that each butt plate must be individually shaped so that replacement of one butt plate with another requires the new part to be ground to the dimensions of the existing firearm stock in addition to renewal of the surface treatment of the stock. For these reasons, the replacement of a conventional butt plate on a do-it-yourself basis has not been generally successful.

Another disadvantage of conventional arrangements arises from the fact that conventional butt plates have been fastened to the stock of the firearm by means of screws threaded into the wood of the stock with the mounting holes receiving the screws being in the same direction as the wood grain. Thus, it has been observed that after removing butt plates which have been screwed to the wooden stock several times, the threads provided in the mounting bores tend to fracture or otherwise fail whereupon the mounting of the butt plate to the stock becomes quite unreliable.

Although it has been attempted to manufacture the firearm stock in an extremely accurate manner on wood lathes to such close dimensions that standard butt plates could be interchangeably mounted on the stock, this technique has not always provided satisfactory results. In particular, since the hardness of the wood from which the stock is formed tends to vary and since the wooden stock absorbs moisture which results in changes in dimension of the stock, deviations between the configuration and dimension of the stock and butt plate occur. It will be understood that even a relatively small stepped surface deviation between the butt plate and the rearward face of the wooden stock affects the overall appearance of the weapon in a deleterious manner.

SUMMARY OF THE INVENTION

Accordingly, it is an object of the present invention to provide new and improved butt assemblies for weapons adapted to be fired from the shoulder, such as a shotgun, which overcomes the disadvantages described above.

It is another object of the present invention to provide a new and improved butt assembly for a firearm which permits an easy replacement of one butt plate for another.

Still another object of the present invention is to provide a new and improved butt assembly for a firearm wherein the butt plate can be extended as desired.

A further object of the present invention is to provide a new and improved butt assembly for a firearm wherein the butt plate can always be reliably mounted to the wooden stock of the weapon and, additionally, such that the mounting of the butt plate to the stock provides an aesthetic visual appearance.

A still further object of the present invention is to provide a new and improved butt assembly for a firearm wherein both length as well as angular adjustments can be easily made as desired to suit the particular requirements of the user of the firearm. In this connection, such adjustments are relatively important in the case where the firearms are used in competition.

Briefly, in accordance with the present invention, these and other objects are attained by providing a butt assembly including a body member mounted on the rearward end face of the weapon stock and which includes a plate-like portion and mounting studs extending forwardly from the plate-like portion. The mounting studs have bores formed therethrough and extend into bores formed in the rearward end face of the weapon stock to mount the body member thereon. The butt assembly further includes a butt plate mounted on the plate-like portion of the body member. Such mounting is accomplished by providing bores in the butt plate situated in aligned relationship with the bores formed in the mounting studs. Threaded fasteners, such as screws, extend through the aligned bores of the butt plate and mounting studs.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
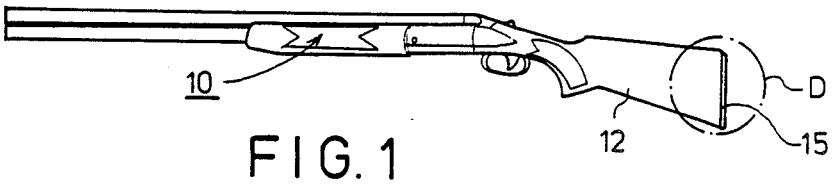
FIG. 1 is a side elevational view of a shotgun incorporating a butt assembly in accordance with the present invention.
Figure 2:
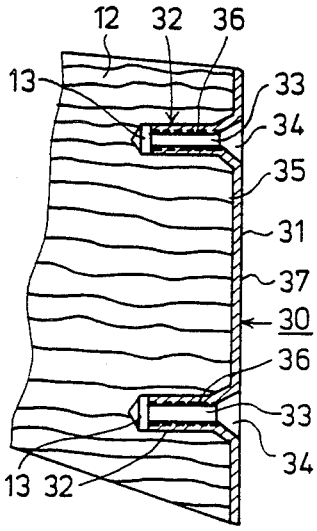
FIG. 2 is a partial view of the stock of the shotgun illustrated in FIG. 1 within the region designated D shown in section along a vertical plane passing through the longitudinal center-line of the stock and illustrating the body member of the butt assembly.

Referring now to the drawings wherein like reference characters designate identical or corresponding parts throughout the several views, and more particularly to FIGS. 1 and 2, the butt assembly of the present invention is illustrated as being applied to the stock 12 of a shotgun 10 although it is understood that the butt assembly of the invention can be applied to other types of weapons which are adapted to be fired from the shoulder. The butt assembly of the invention is generally situated within the region designated D of FIG. 1.

A body member 30 is mounted on the rearward end face 35 of the stock 12 of weapon 10. Preferably, the rearward face 35 of the stock 12 is initially machined to provide a relatively smooth surface therefore. The body member 30 includes plate-like portion 31 and mounting studs 32 which extend forwardly, i.e., towards the forward end of the firearm 10, from the plate-like portion 31. The mounting studs 32 of the body member 30 have internally threaded bores 36 formed therethrough and extend into bores 13 formed in the rearward end face 35 of the weapon stock 12 to mount the body member 30 thereon.

The bores 36 of mounting studs 32 have forwardly tapering centering portions 34 which open onto the rearward face 37 of the plate-like portion 31 of body member 30 for purposes which will be made clear hereinbelow.

The body member 30 is mounted to the rear face 35 of the stock 12 by inserting the mounting studs 32 into the bores 13 formed in the stock, the latter having been suitably chamfered at their respective entrances to receive the tapering portions 34 of the mounting studs. Moreover, the plate-like portion 31 of the body member 30 is preferably glued by suitable adhesive to the rearward face 35 of stock 12 and/or adhesive can be provided between the bores 13 and studs 32 to facilitate the fastening of the body member to the stock. In any case, the use of mounting studs 32 renders the mounting of the body member 30 to the stock 12 exceptionally reliable.

The forward face of the body member 30, which is preferably formed of plastic or rubber, is glued to the rearward face 35 of the stock 12 with the faces mating in tight engagement with each other. Thus, the mating surfaces of the body portion 30 and wooden stock 12 have matching configurations so that a relatively continuous surface engagement is obtained thereby preventing access of water to the wooden stock 12 and thereby eliminating the possibility of swelling of the stock due to absorption of water. In turn, this assures that the rearward surface 35 of stock 12 retains its form under all conditions thereby enhancing the reliability of the mounting of the body member 30 thereto. The rear face 35 of the stock 12 can have either a planar of slightly convex surface which matches the configuration of the forward face of the body member 30. On the other hand, the rearward face 37 of the body member 30 can have a substantially planar or slightly concave configuration.

The shape of the plate-like portion 31 of the body member 30 is such that after the body member 30 has been mounted to the rear face of the stock 12 and the wooden stock 12 and plate-like portion 31 simultaneously ground to the same form, the butt plate 15 and possibly one or more extension members 14, 16, 17 are mounted to the body member 30 without requiring any special adjustments, machining or other operations as described below.

Figure 4:
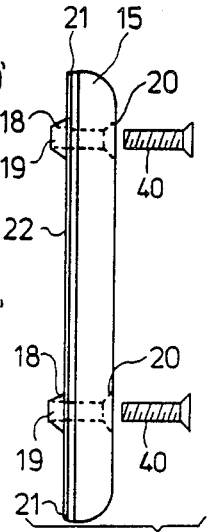
FIG. 4 is a side elevation view of a butt plate and threaded fastener members constituting components of the butt assembly of the present invention.
Figure 5:
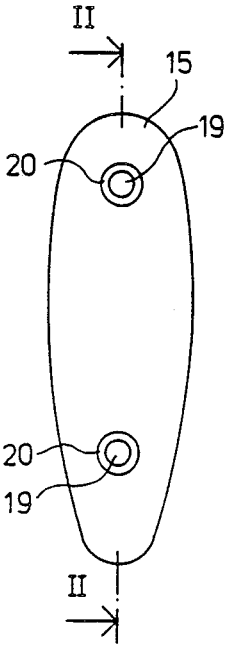
FIG. 5 is a rear elevation view of the butt plate illustrated in FIG. 4.

Referring now to FIGS. 4 and 5, one example of the butt plate 15 constituting a component of the butt assembly of the present invention is illustrated. The butt plate 15 as seen in FIG. 5 has generally the same cross-sectional configuration as the wooden stock 12 as well as body member 30 to which it is mounted. The butt plate 15 is preferably constructed of plastic material with bores 19 formed therethrough in aligned relationship with the bores 33 formed in the mounting studs 32 of the body member 30. Centering projections 18 extend from the forward face 22 of the butt plate 15, the centering projections 19 tapering in a forward direction so as to fit within the tapered portions 34 of the bores 33 of the mounting studs 32. Thus, the centering projections 18 are situated substantially coaxially with respective ones of the bores 19 formed in the butt plate 15. The bores 19 open onto the rearward face of the butt plate 15 and are countersunk at 20.

The forward face 22 of butt plate 15 has an edge region extending around its periphery which is grooved or chamfered as at 21 to form a substantially inwardly directed shoulder in the forward edge region. This groove or chamfer 21 defines a peripherally extending channel between the butt plate 15 and the body member 30 when the former is mounted to the latter to improve the visual appearance of the joint between the butt plate 15 in body member 30 and reduce the visual apparency of any small dimensional or configurational deviations between the butt plate and the body member.

Thus, in one embodiment of the invention, the butt plate 15 is mounted directly on the body member 30 so that the forward face 22 of the butt plate 15 tightly engages the rearward face 31 of the body member 30 with the butt plate bores 19 being axially aligned with the bores 33 formed in the mounting studs 32. The centering projections 18 are received within the tapered portions 34 of the stud bores 33 to center the butt piece 15 with respect to the body member 30. Threaded fasteners 40 (FIG. 4) are inserted through the aligned bores 19, 33 to fixedly mount the butt plate 15 to the body member 30.

Figure 3:
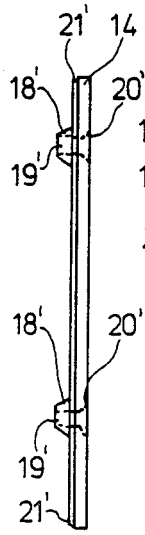
FIG. 3 is a side elevation view of one embodiment of an extension member which may form a component of the butt assembly of the present invention.
Figure 6:
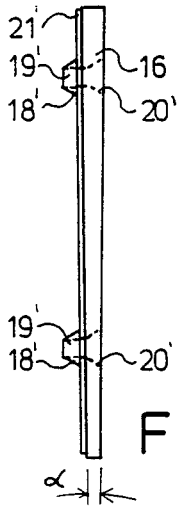
FIG. 6 is a side elevation view of another embodiment of an extension member which may form a component of the butt assembly of the present invention and which is used where the butt plate angle is to be changed.
Figure 7:
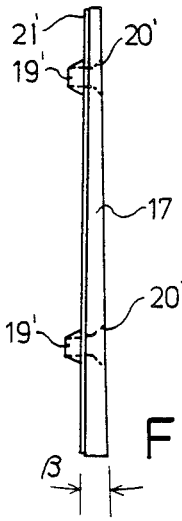
FIG. 7 is a view similar to FIG. 6 and illustrating yet another embodiment of an extension member which may form a part of the butt assembly of the invention and which is used to change the butt plate angle in a direction opposite to that of FIG. 6.

According to another embodiment of the invention, at least one extension member is interposed between the body member 30 and the butt plate 15 to constitute the butt assembly of the invention. Various forms of such extension members are illustrated in FIGS. 3, 6 and 7. The extension members may be utilized to increase the effective length of the stock of the weapon and/or to change the stock angle thereof.

Referring to FIG. 3, the extension member 14 has a plate-shaped configuration having a substantially uniform thickness, i.e., its forward and rearward faces are substantially parallel to each other. Bores 19' are formed through the extension member 14 in aligned relationship with the bores 19 and 33 of the butt plate 15 and mounting studs 32 of the body member 30, respectively. Centering tapered projections or studs 18' extend from the forward face of the extension member 14 and are situated so as to be coaxial with the bores 19' formed therethrough. The bores 19' open onto the rearward face of the extension member 14 and are countersunk at 20'. The forward and rearward faces of the extension member 14 may be substantially planar or slightly convex and/or concave depending upon the particular configuration of the rearward face of the plate-like portion 31 of body member 30 and the forward face 22 of the butt plate 15. Moreover, the extension member 14 has a forward edge region extending around the periphery of the forward face thereof and are suitably grooved or chamfered as at 21' to define a peripherally extending channel between the extension member and the body member 30 when the former is mounted to the latter to reduce the visual apparency of any small dimensional or configurational deviations between the extension member 14 and the body member 30.

In assembly, the extension member 14 is fitted over the plate-like portion 31 of the body member 30 with its centering projections 18' being received within the tapering portion 34 of the bores 33 of the mounting studs 32. The butt plate 15 is then mounted over the rearward face of the extension member 14 with its centering projections 18 being received within the countersunk portions 20' of the bores 19'. Threaded fasteners are then inserted through the aligned bores 19, 19' and 33 to fasten the components of the assembly to each other.

As noted above, the extension member 14 has a substantially uniform thickness so that its provision between the body member 30 and butt plate 15 increases the effective length of the weapon stock 12 but does not change the stock angle, i.e, the angle formed between the rearward face of the butt plate 15 and the longitudinal axis of the firearm 10.

Referring now to the extension member illustrated in FIG. 6, the extension member 16 illustrated therein is substantially similar to the extension member 14 of FIG. 3 and corresponding parts are designated by identical reference numerals. However, extension member 16 has a thickness which is greater at the upper regions thereof, i.e., the forward and rearward faces of extension members 16 taper downwardly towards each other at an angle $\alpha$. Referring to FIG. 7, an extension member 17 is illustrated therein which is essentially similar to the extension members 14 and 16 of FIGS. 3 and 6 with corresponding parts being designated by the same reference numerals. However, the extension member 17 has a thickness which is greater at its lower regions, i.e., the forward and rearward faces of extension members 17 extend at an upwardly tapering angle $\beta$ towards each other, i.e., the angle $\beta$ is substantially opposite to the angle $\alpha$. When either one of the extension members 16 or 17 are interposed between the body member 30 and butt plate 15 in the manner described above in connection with extension member 14, the stock angle of the weapon can be adjusted, which is desirable where the weapon is used in competition.

Referring again to the construction of the butt plate assembly constituting the components illustrated in FIGS. 2, 3 and 4, the body member 30 is fastened to the wooden stock 12 in the manner described above whereupon the stock 12 and plate-like portion 31 of the body member 30 are machined to identical configurations with the rearward face 35 of the stock 12 possibly being treated prior to mounting the body member 30 thereover. The extension member 14 is located so that the centering studs or projections 18' enter into the tapered portions 34 of the bores 33 formed through the mounting studs 32 thereby ensuring that the extension member 14 is precisely located in its proper position. The butt plate 15 is then urged against the rearward face of the extension member 14 so that the centering projections or studs 18 formed on its forward face enter into the countersunk portions 20' of the bores 19' of the extension member 14 thereby ensuring that the butt plate 15 is guided precisely into its proper position. At this time, the threaded fastening members 40 are inserted through the aligned bores 19, 19' and 33, the threaded portion of the fasteners reliably engaging the internal threads 32 provided in the mounting studs 32. As noted above, the chamfered or grooved peripheral edges 21, 21' of the butt plate 15 and extension member 14 ensure a good visual appearance of the butt plate assembly regardless of the presence of any small differences in form and dimension between the components 31, 14 and 15 of the assembly.

The butt assembly of the invention can be dismantled whenever desired by removing the threaded fasteners whereupon another extension member and/or butt plate can be exchanged for the extension member 14 and/or butt plate 15. For example, an extension 16 or 17 as shown in FIGS. 6 and 7 or a new type of butt plate 15 can be substituted for the original components. It will be understood that the butt plate 15 can be suitably padded as desired.

In some circumstances, it may be advantageous to form the opposing, essentially flat or planar faces of the plate-like portion 31 of the body member 30 and the opposed faces of extension members 14, 16 and/or 17, as well as the forward face 22 of butt plate 15 at least slightly concave and/or convex so that their respective edges are situated in the same plane. As a result of the clamping pressure provided by the threaded fasteners, the edges of these components are brought together in an extremely tight fit without any openings to thereby create the butt assembly having a faultless external appearance.

Although the bores 33 formed through the mounting studs 32 of the body member 30 are illustrated as being provided with pre-formed internal threads 36, it will be understood that it is not essential that the threads be pre-formed in the studs. Thus, the bores 33 can be provided with a slightly tapered configuration so that by using appropriate tapered screws as the threaded fasteners, the threads can be tapped in the bores 33 during the mounting of the butt plate 15 to the stock 12. In any case, the body member 30 and particularly the material from which the mounting studs 32 are formed are preferably selected so that a sufficiently durable thread is achieved, taking into consideration the fact that the butt assembly can be dismantled and reassembled several times.

Obviously, numerous modifications and variations of the present invention are possible in the light of the above teachings. It is therefore to be understood that within the scope of the claims appended hereto the invention may be practiced otherwise than as specifically disclosed herein.

I claim:

1. In a weapon adapted to be fired from the shoulder, such as a shotgun or the like, including a stock having a rearward end face, a butt assembly adapted to be coupled to the end face of the stock, comprising:

a body member mounted on the rearward end face of the weapon stock, said body member including a plate-like portion having a forward face and body member mounting means for mounting said body member on said stock with said forward face of said plate-like portion being in relatively continuous surface engagement with the rearward end face of the stock, said body member mounting means including substantially tubular mounting studs integral with said plate-like portion and projecting forwardly therefrom, said mounting studs extending into respective first bores formed in the weapon stock which open onto the rearward end face thereof to mount said body member thereon, each tubular mounting stud defining an interior second bore within it; and a butt plate mounted on said plate-like portion of said body member by butt plate mounting means, said butt plate mounting means including third bores formed in said butt plate, each third bore of said butt plate mounting means being in aligned relationship with a second bore defined by a respective one of said tubular mounting studs of said body member which extends into a respective one of said first bores formed in the weapon stock, said butt plate mounting means further including threaded fastener members extending through respective aligned third and second bores of said butt plate and mounting studs into respective first bores of the weapon stock.

2. The combination of claim 1 further including at least one extension member interposed between said body member and butt plate.

3. The combination of claim 2 wherein said extension member has fourth bores formed therethrough, each fourth bore being in aligned relationship with a respective one of said aligned second and third bores formed in said mounting studs of said body member and said butt plate, and wherein each of said threaded fastener members extends through respective aligned third, fourth and second bores of said butt plate, extension member and mounting studs, said mounting studs themselves extending into said first bores of the weapon stock whereby said at least one extension member is fixedly mounted between said body member and said butt plate.

4. The combination of claim 2 wherein said extension member has a forward edge region extending around the periphery thereof, and wherein a substantially inwardly directed shoulder is formed in said forward edge region of said extension member to define a peripherally extending channel between said extension member and said body member to reduce the visual apparency of small dimensional or configurational deviations between said extension member and said body member.

5. The combination of claim 1 wherein said plate-like portion of said body member has a forward face having a contour which substantially precisely corresponds to the contour of the rearward end face of the weapon stock.

6. The combination of claim 1 wherein said plate-like portion of said body member has a rearward face and said butt plate has a forward face and wherein said second bores formed in said forwardly extending tubular mounting studs of said body member include forwardly tapering centering portions opening at said rearward face of said body member plate-like portion, and further including butt plate centering projections extending from said forward face of said butt plate, said butt-plate centering projections tapering in a forward direction and situated substantially coaxially with respective ones of said third bores formed in said butt plate, each of said centering portions of said second bores adapted to receive a respective one of said butt plate centering projections.

7. The combination of claim 6 further including at least one extension member interposed between said body member and butt plate, said extension member having forward and rearward faces and fourth bores formed through said extension member, each fourth bore being in aligned relationship with a respective one of said aligned second and third bores formed in said mounting studs of said body member and said butt plate, and further including extension member centering projections extending from said forward face of said extension member, said extension member centering projections tapering in a forward direction and situated substantially coaxially with respective ones of said fourth bores formed through said extension member, each of said centering portions of said second bores adapted to receive a respective one said extension member centering projections, and wherein said fourth bores formed in said extension plate include forwardly tapering centering portions opening at said rearward face of said extension plate adapted to receive respective butt plate centering projections.

8. The combination of claim 1 wherein said butt plate has a forward edge region extending around the periphery thereof, and wherein a substantially inwardly directed shoulder is provided in said forward edge region of said butt plate to define a peripherally extending channel between said butt plate and said body member to reduce the visual apparency of small dimensional or configurational deviations between said butt plate and said body member.

9. The combination of claim 1 further including at least one extension member interposed between said body member and butt plate, said extension member including forward and rearward non-parallel faces forming an angle with respect to each other, whereby the butt angle of the weapon relative to the weapon's longitudinal axis is changed by interposing said extension member between said body member and butt plate.

10. The combination of claim 1 wherein said second bores formed through said mounting studs are internally threaded to cooperate with said threaded fasteners.

11. The combination of claim 1 wherein said second bores formed through said mounting studs are initially smooth and wherein said threaded fasteners are constituted by self-tapping screws whereby internal threads are formed on the interior of said second bores formed through said mounting studs when said butt plate is mounted on said plate-like portion of said body member.

12. The combination of claim 1 wherein said butt plate includes a forward face and is mounted to said body member by glueing the forward face of said butt plate to a rearward face of said plate-like portion of said body member.

* * * * *